US006182856B1

(12) United States Patent
Berrenberg et al.

(10) Patent No.: US 6,182,856 B1
(45) Date of Patent: Feb. 6, 2001

(54) WASTE RECEPTACLE

(75) Inventors: Michael Berrenberg, Wenden-Heid; Udo Fröhlingersdorf, Olpe; Oliver Rohleder, Biedenkopf, all of (DE)

(73) Assignee: Gerbr. Otto GmbH & Co. KG, Kreuztal (DE)

( * ) Notice: Under 35 U.S.C. 154(b), the term of this patent shall be extended for 0 days.

(21) Appl. No.: 09/580,255

(22) Filed: May 26, 2000

(30) Foreign Application Priority Data

May 26, 1999 (DE) ..... 199 24 105

(51) Int. Cl.[7] ..... B65F 1/12
(52) U.S. Cl. ..... 220/771; 220/908; 220/770
(58) Field of Search ..... 294/68.1, 68.2, 294/68.26, 68.27; 220/908, 771, 770, 761

(56) References Cited

U.S. PATENT DOCUMENTS 4,778,209 * 10/1988 Zosky et al. ..... 294/68.27
4,969,571 * 11/1990 Bartz ..... 220/771
5,088,750 2/1992 Beese et al. .
5,167,351 * 12/1992 Prout et al. ..... 220/338
5,251,780 * 10/1993 Lee ..... 220/630
5,547,104 * 8/1996 Parker ..... 220/772
5,582,322 * 12/1996 Prout et al. ..... 220/771
5,660,301 * 8/1997 Kaplowitz ..... 220/771
5,772,385 6/1998 Huntoon et al. .

* cited by examiner

*Primary Examiner*—Stephen Castellano
(74) *Attorney, Agent, or Firm*—Herbert Dubno

(57) ABSTRACT

A waste container is composed of synthetic resin material and is provided at the front wall with a recess bridged by a grip formed by front and rear portions. The rear wall portion has extensions defining the small sides of the grip space and merging with the back wall portion of the recess or with a wall parallel thereto and connected with the back wall portion.

16 Claims, 3 Drawing Sheets

WASTE RECEPTACLE

FIELD OF THE INVENTION

Our present invention relates to a waste receptacle composed of a synthetic resin and of the type wherein an upper formation on the front of the container is engageable by a container lifter and a grip is provided below this formation.

BACKGROUND OF THE INVENTION

Waste receptacles, especially for urban refuse removal, have of late been composed of synthetic resin material and can have, on the front of the container, a formation which is engaged by a container lifter of a vehicle into which that container can be dumped.

Below the formation, a grip may be formed from the synthetic resin material of the front wall and can be engaged during the dumping of the container to stabilize it and prevent tilting of the container in an undesired manner. For example, the container lifter or the vehicle may be provided with a lock which can engage the grip. The grip is usually provided so that it bridges two portions of the front wall of the container and itself can have inner and outer walls which are interconnected at their top and by webs between the inner and outer wall portions.

Waste containers of this type have a tendency for the grip to break away after significant usage. Essentially the grip tears loose at its ends so that the container becomes unusable.

OBJECTS OF THE INVENTION

It is, therefore, the principal object of the present invention to provide a waste container, refuse container or garbage or trash receptacle of the aforedescribed type which has a grip of improved stability and more reliable attachment to the front of the wall of the container without increasing the amount of material used.

Another object of this invention is to provide an improved waste container of the type described which is free from the tendency of the grip to tear loose from the container.

Still another object of the invention is to provide an improved container for the purposes described which is free from the drawbacks of earlier systems.

SUMMARY OF THE INVENTION

These objects and others which will become apparent hereinafter are attained, in accordance with the invention, in a waste container composed of a synthetic resin material and comprising front, rear and side walls and a bottom, the front wall being provided with an upper formation for engagement by a container lifter for dumping of the container and with a grip below the formation, the grip being elongated and defining a grip space with the front wall, the grip being formed from the synthetic resin material with inner and outer wall portions interconnected at an upper side of the grip and by spaced apart vertical webs, the inner wall portion of the grip having extensions at opposite ends defining small sides of the grip space.

More specifically, the objects set out above are achieved by providing the inner wall of the grip which is proximal to the interior of the container with extensions at both of its ends forming at least the small sides of the space defined between the grip and the front wall With such a transition between the inner wall portion of the grip and the front wall of the container formed by the extensions which define the small sides of the grip space, an optimum force distribution is obtained at the grip and a more reliable retention of the grip on the remainder of the container. In the region of the grip ends the material no longer has a tendency to tear and thus the resulting grip construction has greater stability without requiring metallic reinforcement of the high stress regions of the grip.

An especially reliable attachment of the grip is obtained when the grip bridges a recess formed on the front outer wall of the container and the extensions are formed on or merge with the back wall portion of the recess. Stability is still further enhanced when the extensions are of arcuate configuration and especially parts of a circle, are or semicircular configuration.

An especially advantageous construction is obtained when the extensions merge with a wall parallel to the back wall of the recess and which is formed on the back wall. The parallel wall can be spaced from the back wall. The inner wall portion of the grip can thus form a closed oval which, in turn, provides especially high stability.

It has been found to be advantageous to space the inner wall extensions from the side wall portions of the recess and to bridge the gap between the two by vertical ribs. It is also advantageous to configure the space, hereinafter the grip space, so that it is oval and has a length greater than its width.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
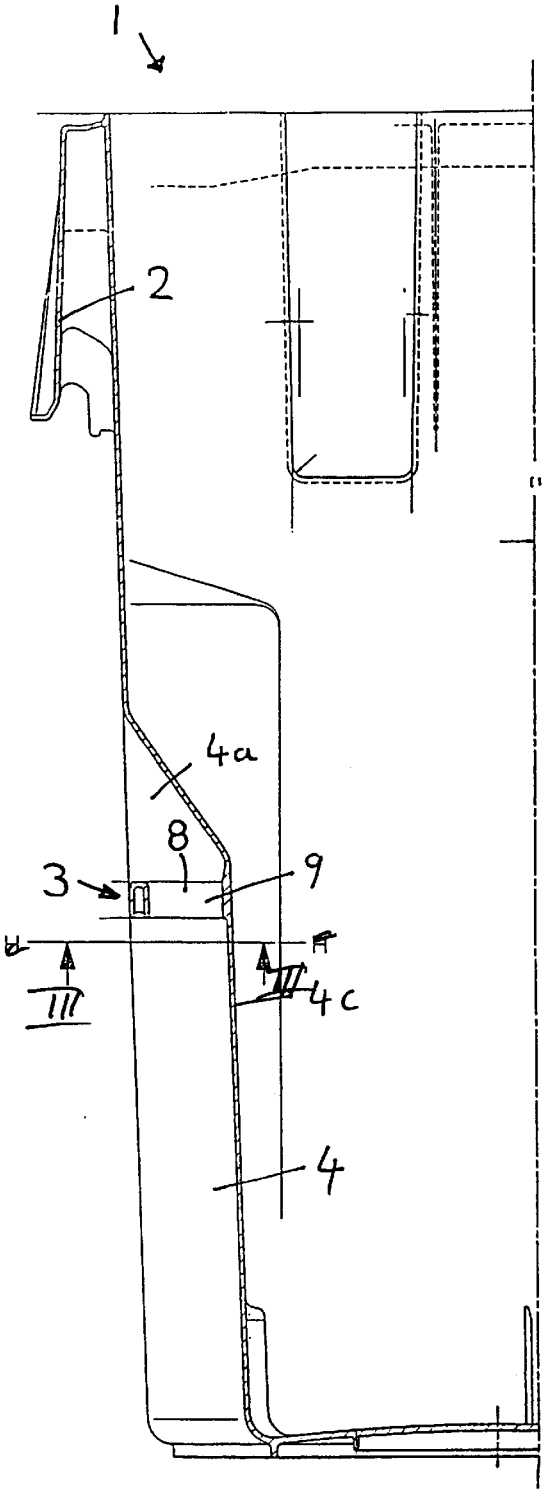
FIG. 1 is a vertical portion through half of a trash container according to the invention.
Figure 2:
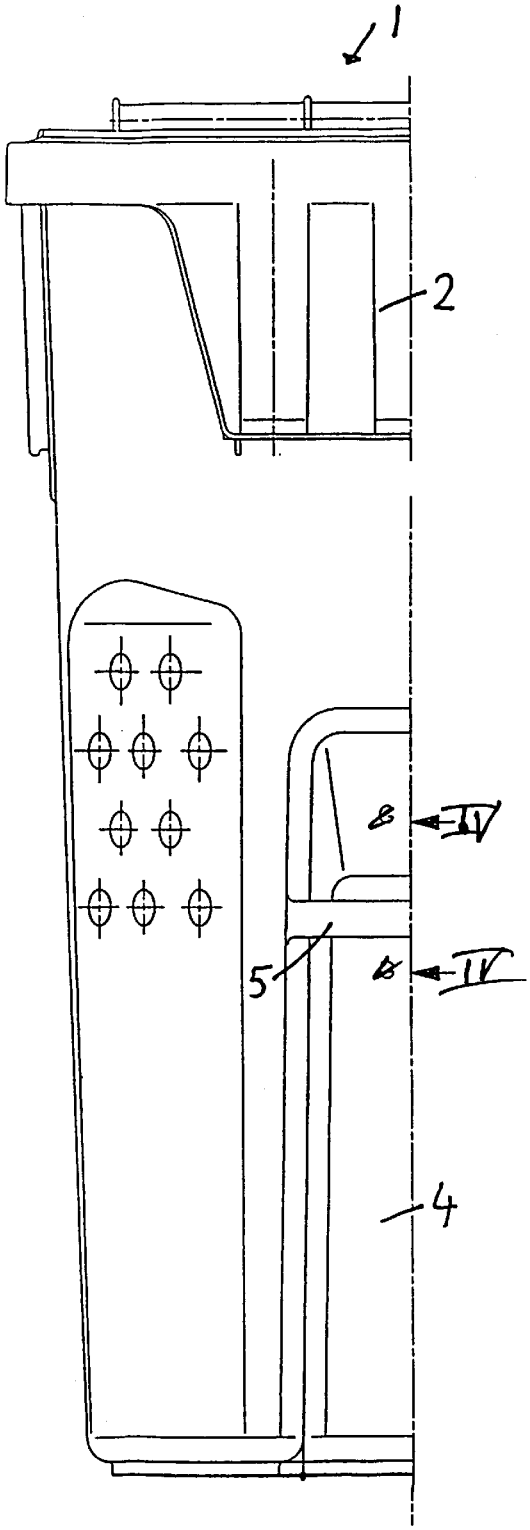
FIG. 2 is another vertical section through the container.
Figure 4:
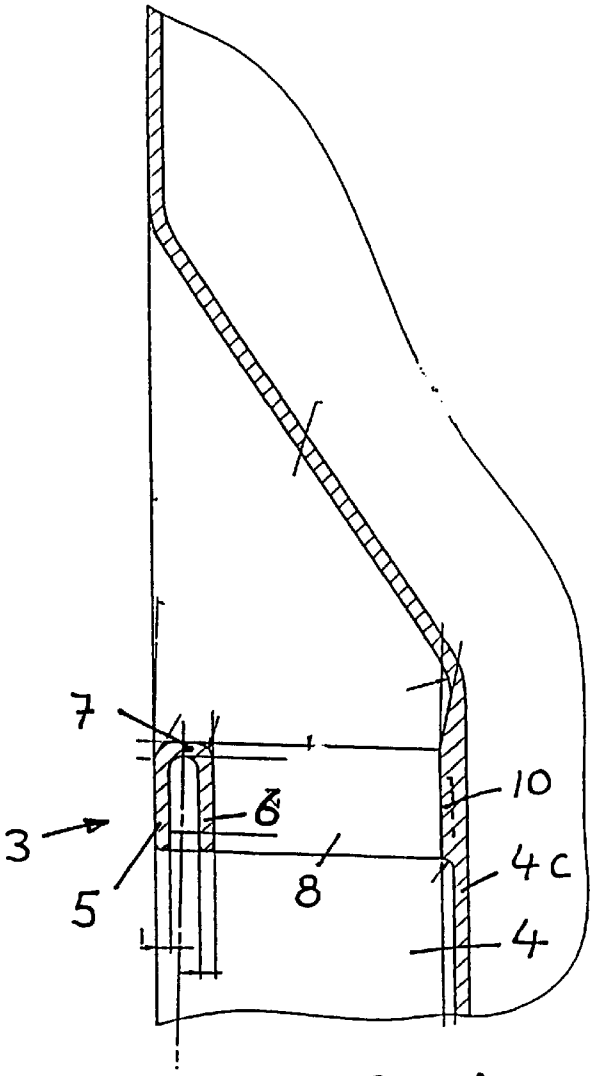
FIG. 4 is a section taken along the line IV—IV of FIG. 2.
Figure 3:
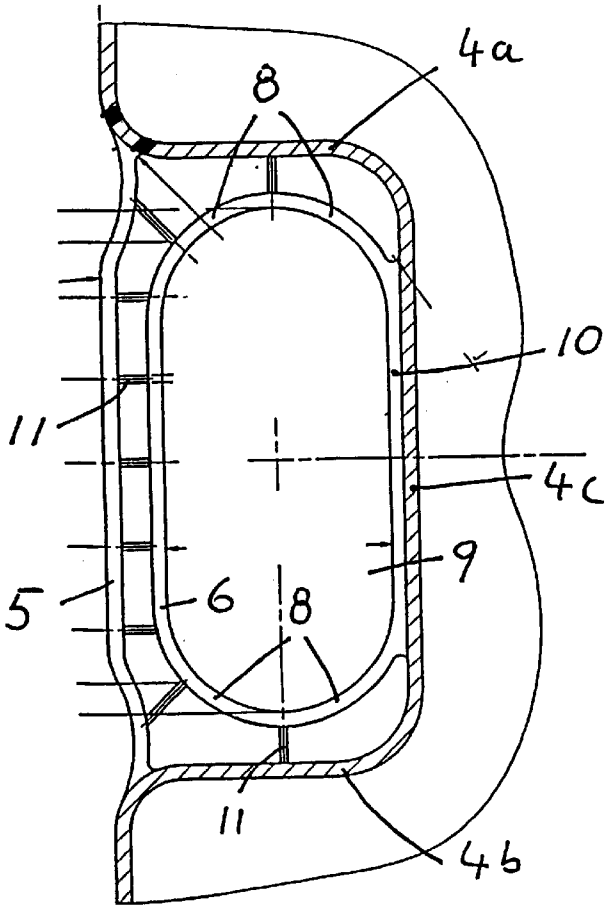
FIG. 3 is a section taken along the line III—III of FIG. 1.

The waste container 1 of the drawing is formed form a synthetic resin material and has a cover. It is formed at its front side or wall with a formation or socket 2 to which can receive the upwardly extending tongue of a container lifter on a trash collection vehicle, the latter lifting the container and dump the contents thereof into the vehicle. During the dumping operation, the container is turned completely so that its normally upwardly open end is inverted and opens downwardly into the container.

Since the container, when inverted, may slip from the lifter or may tilt in an uncontrolled manner, it is also provided with a grip below the socket 2 and which can be engaged by a hook shaped part of the lifter or vehicle. This hook shaped part can engage behind or around the grip and prevents the container from falling out of the lifter.

The grip 3 is provided below the socket formation 2 on the front of the container and is composed of the synthetic resin material of the container.

For this purpose, the container 1 is formed with a recess 4 set back into the container and which is bridged by the substantially horizontal grip. The front side of the grip or the front side of the outer wall 5 of the grip 3 lies substantially in the plane of the front wall of the container in the region of the grip. The grip 3 has an inner wall which is parallel to the vertical outer wall 5 and thus is also vertical, the wall portions 5 and 6 being interconnected by a curved top 7. In addition, the outer wall 5 and the inner wall 6, together with the upper part 7 form a channel of U-shaped cross section which is opened downwardly.

The recess 4 has lateral flanks or side wall portions 4*a* and 4*b*, in addition to the back wall portion 4*c* and is bridged by the grip 3 in such manner that the outer wall 5 of the grip forms a transition with the outer wall of the container. The inner wall portion 6, however, is not affixed to the outer wall of the container or to the lateral walls or flanks 4*a* and 4*b* of the recess directly. Rather, the inner wall 6 has at both ends respective extensions 8 which are of circular segmental configuration and are arcuate inwardly and especially conform to semicircular members in horizontal cross section. They form the ends of a grip space defined between the grip and the back wall portion 4*c* within the recess 4. The grip space 9 is an elongated oval as defined between the inner wall portion 6, the two lateral extensions 8 and the back wall portion 4*c*.

Figure 5:
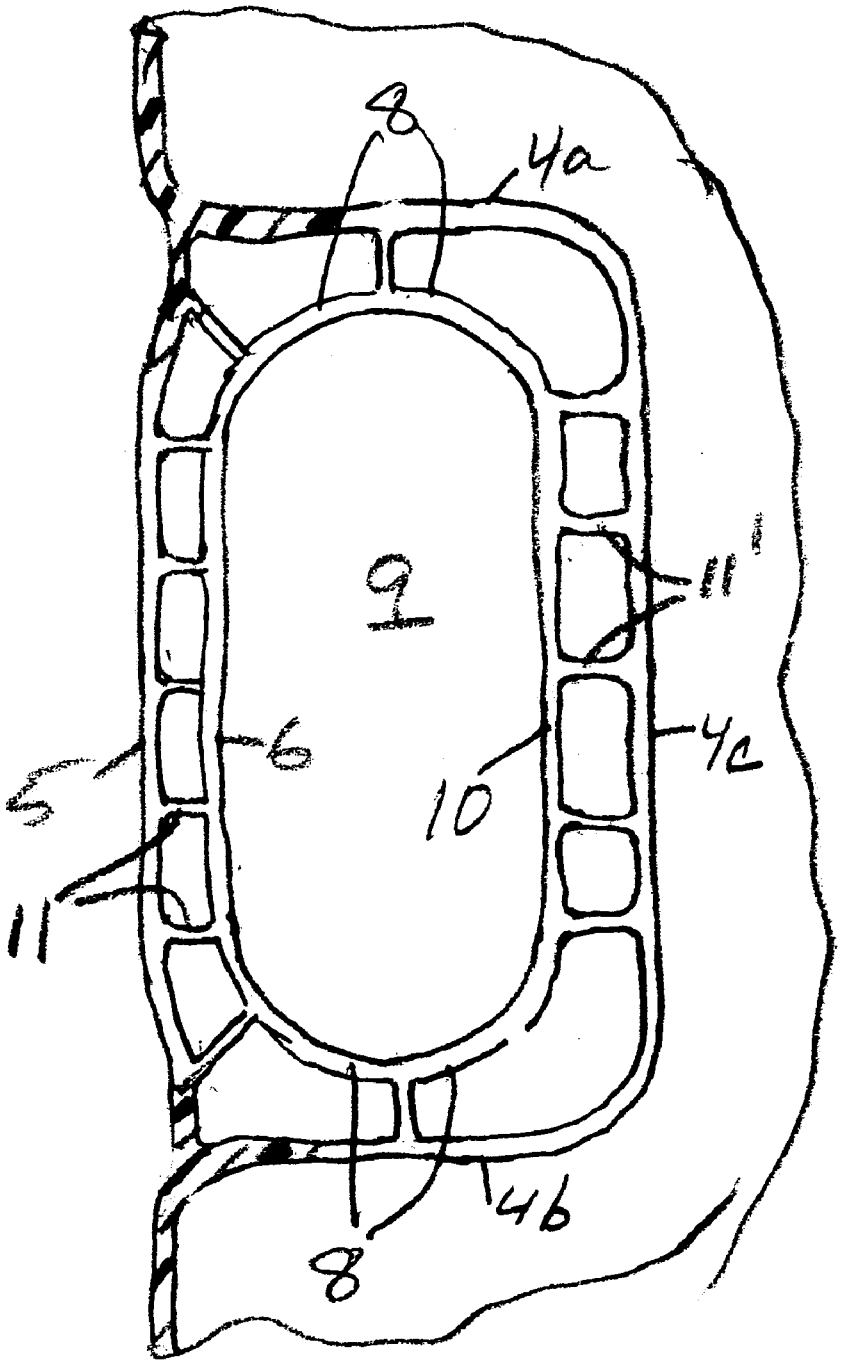
FIG. 5 is a view similar to FIG. 3 but of a grip in which the extensions merge with a wall parallel to the back wall portion of the recess but spaced therefrom.

In the embodiment of FIGS. 1–4, the two extensions 8 merge directly with a wall 10 parallel to the back wall portion 4*c* which is formed in one piece with that back wall portion and is continuous therewith. In the embodiment of FIG. 5, however, the extensions 8 merge with a parallel wall 10 which is spaced from the rear wall portion 4*c*. If desired, the space between the walls 10 and 4*c* can be equal to the spacing between the walls 5 and 6. In that case they are bridged by webs 11' similar to the webs 11 connecting the wall portions 5 and 6. The webs 11 and 11' can run vertically and can be perpendicular to the wall portions 5 and 6.

The inner wall portion together with the semicylindrical extensions 8 and the wall portions 10 and/or 4*c* can thus define an inner space 9 which extends vertically and is of greater horizontal length than its width and which can receive the hook or like retainer of the lifter. With security against tearing loose of the grip.

We claim:

1. A waste container composed of a synthetic resin material and comprising front, rear and side walls and a bottom, said front wall being provided with an upper formation for engagement by a container lifter for dumping of the container and with a grip below said formation, said grip being elongated and defining a grip space with said front wall, said grip being formed from said synthetic resin material with inner and outer wall portions interconnected at an upper side of the grip and by spaced apart vertical webs, the inner wall portion of said grip having extensions at opposite ends defining small sides of the grip space.

2. The waste container defined in claim 1 wherein said front wall is formed with a recess bridged by said grip and having a back of the recess spaced from said grip, said extensions connecting said ends with the back of said recess.

3. The waste container defined in claim 2 wherein said extensions are arcuate.

4. The waste container defined in claim 3 wherein said extensions are of semicircular configuration.

5. The waste container defined in claim 4 wherein said back is formed with a wall portion parallel to said grip, said extensions running into said wall portion parallel to said grip.

6. The waste container defined in claim 5 wherein said wall portion parallel to said grip is spaced from said back.

7. The waste container defined in claim 5 wherein said recess has sides connected to said back, said extensions being spaced from said sides.

8. The waste container defined in claim 7 wherein a space between said extension and said sides is bridged by spaced-apart vertical webs.

9. The waste container defined in claim 8 wherein said space is an oval with a length greater than a width of the space.

10. The waste container defined in claim 1 wherein said extensions are arcuate.

11. The waste container defined in claim 10 wherein said extensions are of semicircular configuration.

12. The waste container defined in claim 1 wherein said front wall of formed with a recess having a back and formed with a wall portion parallel to said grip, said extensions running into said wall portion parallel to said grip.

13. The waste container defined in claim 12 wherein said wall portion parallel to said grip is spaced from said back.

14. The waste container defined in claim 1 wherein said front wall has a recess bridged by said grip and formed with sides, said extensions being spaced from said sides.

15. The waste container defined in claim 14 wherein a space between said extension and said sides is bridged by spaced-apart vertical webs.

16. The waste container defined in claim 15 wherein said grip space is an oval with a length greater than a width of the grip space.

* * * * *